United States Patent [19]

Nishioka

[11] Patent Number: 4,599,986

[45] Date of Patent: Jul. 15, 1986

[54] ARCHERY BOW

[76] Inventor: Jim Z. Nishioka, 1268 Hemlock NW., Salem, Oreg. 97304

[21] Appl. No.: 642,397

[22] Filed: Aug. 20, 1984

[51] Int. Cl.[4] ..... F41B 5/00

[52] U.S. Cl. ..... 124/24 R; 124/DIG. 1

[58] Field of Search ..... 124/24 R, 23 R, 86, 124/DIG. 1, 90

[56] References Cited

U.S. PATENT DOCUMENTS

| | | | |
|---|---|---|---|
| 2,957,470 | 10/1960 | Barna | 124/24 R |
| 3,486,495 | 12/1969 | Allen | 124/24 R |
| 4,076,005 | 2/1978 | Hill | 124/24 R |
| 4,512,326 | 4/1985 | Jarrett | 124/DIG. 1 |

OTHER PUBLICATIONS

Advertisement in "Archery World", Nov., 1978, p. 66, RLC Archery Enterprises, Inc., P.O. Box 8530, Portland, OR 97207.

*Primary Examiner*—Richard C. Pinkham
*Assistant Examiner*—Benjamin Layno

[57] ABSTRACT

A compound bow comprising a first arm and a second arm with each arm having an end portion respectively. A bowstring main span extends between the arm end portions and a compound cable main span also extends between the arms. A pair of rotatable guide members, supported by a pair of shafts, are positioned on the arm end portions respectively to guide the bowstring. The compound cable main span engages one of the arm end portions rearwardly of one of the shafts.

13 Claims, 5 Drawing Figures

ARCHERY BOW

BACKGROUND OF THE INVENTION

This invention relates to new and useful improvements in archery bows.

A compound cable is a link between an eccentric and a bow arm. It is a common practice in the trade to anchor a compound cable to a bow arm forwardly of a rotatable bowstring guide member or on a shaft supporting such guide member. While this positioning of the compound cable does provide bow arm leverage to the eccentric, such leverage is restricted to that portion of the arm forwardly of the shaft.

Providing a bow with an adjustable draw length has been difficult to achieve. Changing sizes of bowstring guide members or changing of parts of the bowstring guide member is commonly employed, however, this requires an additional inventory of parts.

SUMMARY OF THE INVENTION

According to the present invention and forming a primary objective thereof is to provide a bow with smooth drawing qualities and a good breakover. An archery bow is provided with a rotatable guide member, a shaft supporting such guide member, a bowstring main span, a compound cable main span and a means to position at least a portion of the compound cable main span rearwardly of the bowstring main span and the shaft.

Another important objective is to provide a bow with means to connect a compound cable main span to an arm end portion rearwardly of one or more of the following: a bowstring main span, an eccentric, a rotatable guide member, a shaft supporting such rotatable guide member, and a bore supporting the shaft.

Another important objective is to provide a bow which allows selective positioning of various elements of the bow, such elements including a rotatable guide member, a shaft supporting the guide member, a bracket for supporting the shaft, an eccentric, a bowstring main span and a compound cable main span.

Another object is to provide a bow with a closed slot on an arm end portion to receive a rotatable guide member with a compound cable main span connected to the arm end portion rearwardly of such closed slot.

Still another object is to provide a bow with a bracket on an arm end portion for rotatably supporting a rotatable guide member. The bracket has a rearwardly extending portion for engaging a compound cable main span.

Another object is to provide a bow with a bracket on an arm end portion with a forwardly extending arm for engaging a compound cable main span.

Still another object is to provide a bow with a pylon which extends rearwardly from a body portion of the bow and positions a portion of the compound cable main span rearwardly of the bowstring main span.

The invention will be better understood and additional objects and advantages thereof will become apparent from the following description taken in connection with the accompanying drawings.

DETAILED DESCRIPTION OF THE PREFERRED EMBODIMENTS

Figure 1:
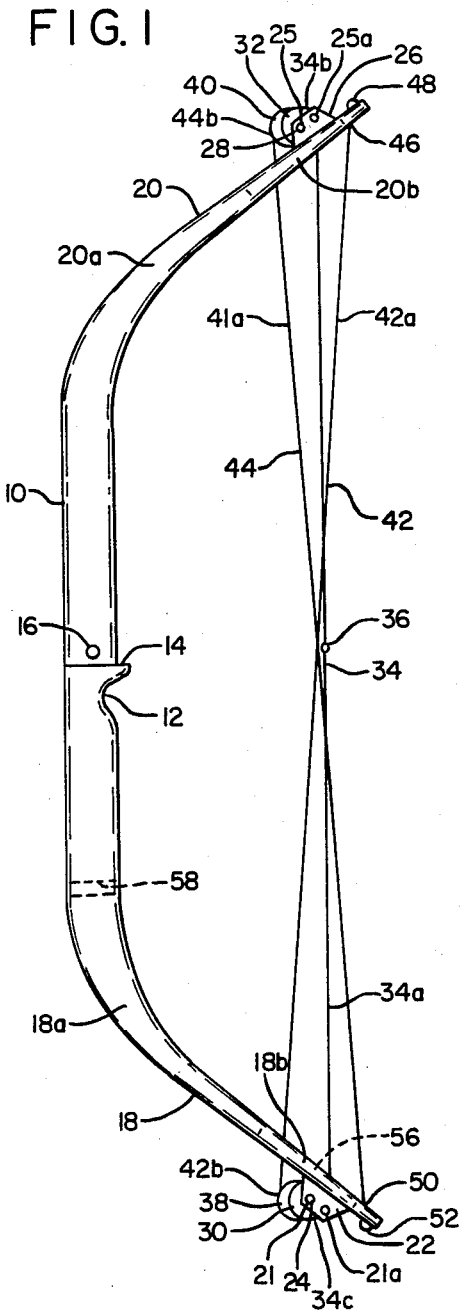
FIG. 1 is a side elevational view of an archery bow embodying features of the invention.

With reference first to FIGS. 1–4 which show a first form of the invention, an archery bow includes a body portion 10 of the usual construction, such body portion having a hand grip 12, a projectile shelf 14 and a projectile rest 16. A pair of bow arms 18 and 20 extend oppositely from the body portion 10 and include base portions 18*a* and 20*a* and end portions 18*b* and 20*b* respectively. The base portions 18*a* and 20*a* are connected to body portion 10 and end portions 18*b* and 20*b* extend rearwardly from the respective base portions. At least one of the arms is flexible and provides tension for the bow.

A bore 21 through a ramp 22 on arm end portion 18*b* supports a shaft 24. A bore 21*a* is similar to bore 21 and allows selective positioning of shaft 24. A bore 25 extends transversely through a ramp 26 on arm end portion 20*b* and supports a shaft 28. A bore 25*a* is similar to bore 25 and allows selective positioning of shaft 28.

The shafts 24 and 28 rotatably support a pair of rotatable guide members 30 and 32 which guide a bowstring 34. The bowstring 34 has a main span 34*a* which extends between the rotatable guide members 30 and 32. The bowstring also includes a pair of end spans 34*b* and 34*c* which wrap around rotatable guide members 32 and 30 respectively. Bowstring end span 34*b* can be best seen in FIG. 2. A nocking point for the bow is 36. Bowstring 34 is movable rearwardly in drawing movements of the bow. The bowstring 34 is shown in a pre-draw condition, such condition being before a draw force has been applied to the bowstring main span 34*a*.

A pair of eccentrics 38 and 40 are rotatably supported by shafts 24 and 28 respectively and control breakover tension for bowstring 34. Eccentric 38 is secured to rotatable guide member 30 and eccentric 40 is secured to rotatable guide member 32.

A pair of compound cables 42 and 44 extend between arms 18 and 20. Compound cable 42 includes a main span 42*a* and an end span 42*b*. Compound cable main span 42*a* links eccentric 38 to arm end portion 20*b* and compound cable end portion 42*b* wraps around eccentric 38. Compound cable main span 42*a* is connected to arm end portion 20*b* by bore 46 and is secured by an enlargement 48.

Compound cable 44 includes a main span 44*a* and an end span 44*b*. Compound cable main span 44*a* links eccentric 40 to arm end portion 18*b* and compound cable end span 44*b*, best seen in FIG. 2, wraps around eccentric 40. The compound cable main span 44*a* is connected to arm end portion 18*b* by a bore 50 and is secured by an enlargement 52. In this preferred construction, compound cable main spans 42*a* and 44*a* are shown terminating on arm end portions 20*b* and 18*b* respectively, however, such main spans may be terminated elsewhere on the bow.

Figure 2:
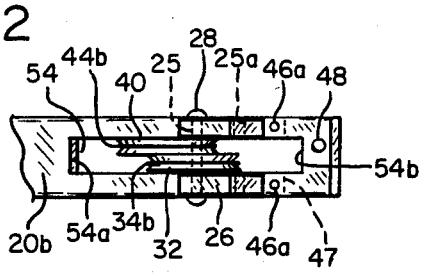
FIG. 2 is an enlarged fragmentary top plan view of the archery bow of FIG. 1.

A slot 54 in arm end portion 20*b*, best seen in FIG. 2, receives rotatable guide member 32 and eccentric 40 and includes a forward wall 54*a* and a rearward wall 54*b* which closes such slot. The rearward wall 54*b* strengthens the slot to resist twisting of arm end portion 20*b*. Shaft 28 extends transversely across closed slot 54. A slot 56 on arm end portion 18*b* is similar to slot 54 and also includes closed forward and rearward walls.

A threaded bore 58 is for receiving a pylon which will be discussed with reference to FIG. 3.

In operation of the preferred bow of FIG. 1, a draw force on bowstring main span 34*a* causes rotation of both rotatable guide member 30 and eccentric 38 which in turn shortens compound cable main span 42*a*. Eccentric 38 and compound cable main span 42*a* apply the draw force to arm end portion 20*b*, such draw force being applied rearwardly of rotatable guide member 32 and shaft 28. Eccentric 40 and compound cable main span 44*a* will apply a similar draw force to arm end portion 18*b* rearwardly of rotatable guide member 30 and shaft 24.

Figure 3:
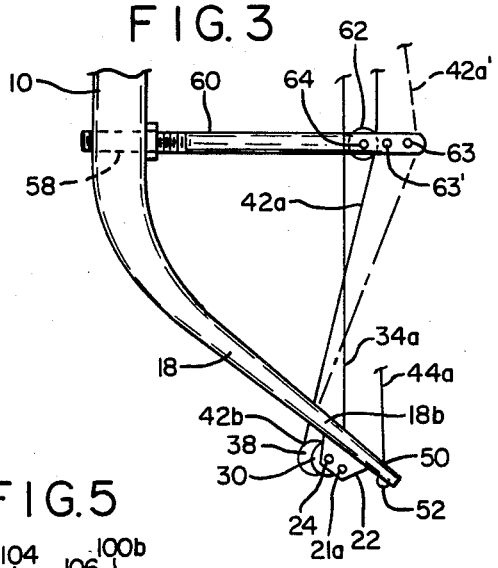
FIG. 3 is a fragmentary side elevational view of the archery bow of FIG. 1 and including a pylon.

Referring to FIG. 3, a pylon or support arm 60 is shown engaged to a threaded bore 58 on body portion 10 of the bow of FIG. 1. A pulley 62 is supported by a shaft 64 and urges a portion of compound cable main span 42*a* rearwardly past bowstring main span 34*a*. Pylon 60 positions at least a portion of compound cable main span 42*a* rearwardly of bowstring main span 34*a* independently of the connecting devices of the bow. This rearwardly positioning of compound cable main span 42*a* improves its angle of engagement to eccentric 38 which promotes smooth breakover for the bow. Arm 60 includes a bowstring side adjacent to bowstring main span 34*a* and an opposite cable side adjacent to compound cable main span 42*a*. A pair of pins or studs 63 and 63′ extend from the cable side of the arm and allow rearwardly positioning of cable 42*a* shown as broken lines 42*a*′ engaged to pin 63.

Figure 4:
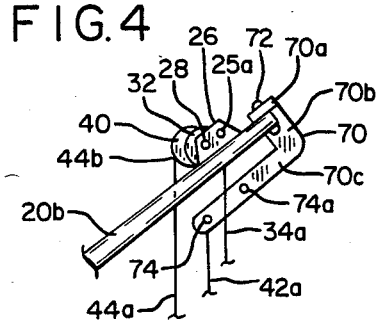
FIG. 4 is a fragmentary side elevational view showing a modification of the bow of FIG. 1.

FIG. 4 shows another modification of the preferred bow of FIG. 1 and includes a bracket 70. Such bracket comprises a top portion 70*a*, an inwardly extending portion 70*b*, a forwardly extending arm portion 70*c* and a bore 74 through such arm for receiving compound cable main span 42*a*. Compound cable main span 42*a* is connected to the forwardly extending arm portion 70*c* so that while the connection of compound cable main span 42*a* to arm end portion 20*b* is positioned forwardly of shaft 28, tension in such cable main span is exerted on the arm end portion 20*b* rearwardly of the shaft. A bore 74*a* allows selective positioning of compound cable main span 44*a*. The arm provides good cable and projectile clearance while utilizing the leverage of the rearwardly placed connection of the compound cable main span 42*a* to the arm end portion 20*b*.

Figure 5:
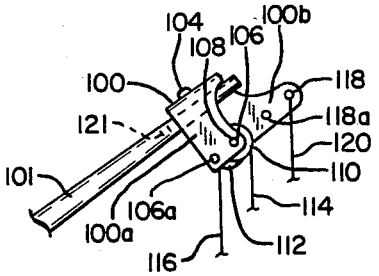
FIG. 5 is a fragmentary side elevational view showing another modification of the archery bow of FIG. 1.

Referring to FIG. 5 there is shown still another embodiment of the invention. A bracket 100 is secured to arm end portion 101 by a bolt 104. A bore 106 through bracket 100 supports a shaft 108 which in turn rotatably supports a rotatable guide member 110 and an eccentric 112. Bore 106*a* allows selective positioning of shaft 108 so that a user can selectively move shaft 108 forwardly to bore 106*a*. A bowstring main span 114 is engaged to rotatable guide member 110 and a compound cable main span 116 is engaged to eccentric 112. A rearwardly extending portion 100*b* of the bracket 100 includes a bore 118 which receives a compound cable main span 120. A bore 118*a* allows selective forwardly positioning of compound cable main span 120. Compound cable main span 120 is connected to arm end portion 101 by bore 118 in rearwardly extending portion 100*b*. Such connection is is positioned rearwardly of arm end portion 101 and rearwardly of bowstring main span 114, bore 106, shaft 108, rotatable guide member 110 and eccentric 112. Bore 121 is for receiving bolt 104 and allows selective positioning of bracket 100 on arm end portion 101.

An important feature of the present invention is that the compound cable main span 42*a* of the preferred construction of FIG. 1 is connected to arm end portion 20*b* rearwardly of elements which include: rotatable guide member 32, shaft 28 supporting such rotatable guide member, bore 25 supporting such shaft, eccentric 40, bowstring main span 34*a* and nocking point 36. This rearwardly connection of the compound cable main span 42*a* to arm end portion 20*b* relative to one or more of such elements described promotes a smooth draw and breakover for the bow. Conversely stated, such elements are positioned forwardly of such connection of the compound cable main span 42*a* to the arm end portion 20*b*.

Other examples of this feature include: In FIG. 1, such connection is positioned rearwardly of rotatable guide member 30, shaft 24, bore 21, eccentric 38, bowstring main span 34*a* and nocking point 36. In FIG. 4 such connection is positioned rearwardly of rotatable guide member 32, shaft 28, bore 25, eccentric 28 and bowstring main span 34*a*. In FIG. 5, such connection is positioned rearwardly of rotatable guide member 110, shaft 108, bore 106, eccentric 112 and bowstring 114.

Another important feature of the present invention is that various devices or means are employed to position at least a portion of the compound cable main span rearwardly of the elements described to promote a smooth draw and breakover. These devices can be located on various parts of the bow such as on the arm end portions or on the body portion as shown in the preferred constructions of FIGS. 1–4. Furthermore, the devices may include connecting devices for connecting the compound cable main span to the arm end portion. Such devices may be employed individually or in combination to accomplish the intended functions. Examples of such devices include: In FIG. 1, such device includes bore 46 and enlargement 48 which connect compound cable main span 42*a* to arm end portion 20. Also in FIG. 1, such device includes bore 50 and enlargement 52 which connect compound cable main span 44*a* to arm end portion 18*b*. In FIG. 3, such device includes pylon 60 and pulley 62. In FIG. 5, such device includes bracket 100 and bores 118 and 118*a*. The device shown in FIGS. 1, 4 and 5 are positioned on arm end portions while the pylon shown in FIG. 3 is supported by the body portion 10.

Still another important feature of the present invention is the angle of engagement of the compound cable main span 42*a* to eccentric 38 on arm end portion 18*b* of the preferred construction of FIG. 1. The connection of the compound cable main span 42*a* to arm end portion 20*b* is positioned rearwardly of shaft 28 which provides an improved angle of engagement of such main span to the eccentric for a smooth breakover for the bow.

Furthermore, it can be seen that arm end portion 20*b* has more influence or leverage on eccentric 38 than if the compound cable main span 42*a* was connected to shaft 28 or connected to arm 20 forwardly of such shaft. As mentioned previously, connecting compound cable main span 42*a* to shaft 28 or to arm 20 forwardly of such shaft is a common practice in the trade. The present invention increases the influence or leverage of the arm end portion 20*b* on eccentric 38 which promotes smooth draw and breakover as well as good projectile speed. Also, compound cable main span 42*a* crosses bowstring main span 34*a*. Similarly, compound cable main span 44*a* extends from eccentric 40, crosses bowstring main span 34*a* and is connected to arm end portion 18*b* by bore 50. The connection for the compound cable main span 44*a* to arm end portion 18*b* is positioned rearwardly of shaft 24.

The fact that compound cable main spans 42*a* and 44*a* are connected to respective arm end portions 20*b* and 18*b* rearwardly of the bowstring main span 34*a* also promotes a smooth draw and breakover for the bow.

Another feature of the present invention is that some elements of the bow can be adjusted or selectively positioned to adjust the draw length of the bowstring and also to change shooting characteristics of the bow. Shaft 28, best seen in FIG. 2, can be selectively positioned in bore 25*a*. Rotatable guide member 32, eccentric 40, compound cable main span 44*a*, bowstring end span 34*b* and bowstring main span 34*a* are supported by shaft 28, therefore, will move rearwardly with such shaft when it is selectively positioned in bore 25*a*. Similarly, shaft 24 on arm end portion 18*b*, FIG. 1, can be selectively positioned in bore 21*a* to selectively position rotatable guide member 30, eccentric 38, compound cable main span 42*a*, bowstring end span 34*c* and bowstring main span 34*a*. Furthermore, compound cable main span 42*a*, FIG. 1, may be selectively positioned in bores 46*a*, best seen in FIG. 2. This allows the user to adjust the leverage or influence of arm 20. Arm end portion 18*b* may have a bore similar to 46*a*, FIG. 2, for selective positioning of compound cable main span 44*a*.

Referring to FIG. 4 compound cable main span 42*a* can be selectively connected to bore 74*a* to selectively position such main span. In FIG. 5, shaft 108 can be selectively positioned in bore 106*a* to forwardly position rotatable guide member 110, eccentric 112, compound cable main span 116, and bowstring main span 114. The compound cable main span 120 can be selectively positioned in bore 118*a* to forwardly position such compound cable main span. Bracket 100 can be selectively positioned by locating bolt 104 in bore 121 on arm end portion 101.

The connection of compound cable main spans to arm end portions is accomplished by bores, enlargements and brackets in the embodiments shown in this disclosure, however, other means of connecting, such as notches, bolts, yokes, and the like may be employed.

In the preferred embodiment of FIG. 1, the rotatable guide members 30 and 32 are centrally supported by shafts 24 and 28 respectively, however, other shapes and off-center support by the shafts may be employed.

Referring again to FIG. 2, bow arm end portion 20*b* may be shortened to a length indicated by broken lines 47 and the compound cable main span 42*a* connected to one or both bores 46*a*. A device, such as a yoke, may be employed on the end of the compound cable main span 42*a* to engage both bores 46*a*. This provides a compact bow.

Some features of the present invention may be employed with other bow designs such as applicant's bow structure shown in U.S. Pat No. 4,365,611. Such structure employs only one eccentric and one flexing arm.

It is to be understood that the forms of my invention herein shown and described are to be taken as preferred examples of the same and that various changes in the shape, size and arrangement of parts may be resorted to without departing from the spirit of my invention, or the scope of the subjoined claims.

Having thus described my invention, I claim:

1. An archery bow comprising a body portion, a bowstring on said bow movable rearwardly in drawing movements of the bow, said bowstring having a pre-draw condition, the pre-draw condition being before a draw force is applied to said bowstring, a nocking point on said bowstring, first and second oppositely extending arms on said body portion with at least one of said arms being flexible for providing a tension for said bowstring, said arms each having a base portion and an end portion respectively, said base portions connected to said body portion, bowstring guide means for guiding said bowstring, said bowstring guide means comprising a first rotatable guide member on said first arm end portion and a second rotatable guide member on said second arm end portion, said bowstring including a main span and a pair of end spans, said bowstring main span extending between said first and second rotatable guide members, said pair of bowstring end spans wrapping around said first and second rotatable guide members respectively, eccentric means on said bow connected to said first rotatable guide member for controlling a breakover tension in said bowstring, a compound cable including a compound cable main span and a compound cable end span, said compound cable end span wrapping around said eccentric means, said compound cable main span extending between said eccentric means and said second arm end portion, shaft means on said second arm end portion rotatably supporting said second rotatable guide member, and connecting means on said second arm end portion for connecting said compound cable main span to said second arm end portion, said connecting means being positioned on said second arm end portion rearwardly of said shaft means, said connecting means being non-rotatable during a drawing movement of the bow, and during a drawing movement of the bow said compound cable main span will exert a portion of the draw force on said second arm end portion rearwardly of said shaft means.

2. The archery bow of claim 1 wherein said compound cable main span is rigidly terminated on said second arm end portion rearwardly of said shaft means for exerting a portion of the draw force on said second arm end portion rearwardly of said shaft means.

3. The archery bow of claim 1 wherein said connecting means rigidly connects said compound cable main span to said second arm end portion rearwardly of said eccentric means for exerting a portion of the draw force on said second arm end portion rearwardly of said shaft means.

4. The archery bow of claim 1 wherein said connecting means rigidly connects said compound cable main span to said second arm end portion rearwardly of said rotatable guide member for exerting a portion of the draw force on said second arm end portion rearwardly of said rotatable guide member.

5. The archery bow of claim 1 wherein said connecting means includes multiple connections for selectively and rigidly connecting said compound cable main span to said second arm end portion, said multiple connections being positioned on said second arm end portion rearwardly of said shaft means for exerting a portion of the draw force on said second arm end portion rearwardly of said shaft means.

6. The archery bow of claim 1 wherein said connecting means includes a bracket, said bracket including a rearwardly extending portion, said compound cable main span being rigidly connected to said rearwardly extending portion of said bracket, said rigid connection being positioned rearwardly of said shaft means for exerting a portion of the draw force on said second arm end portion rearwardly of said shaft means.

7. The archery bow of claim 6 wherein said rigid connection is positioned rearwardly of said second arm end portion.

8. The archery bow of claim 1 wherein said connecting means includes an arm extending forwardly past said shaft means, said compound cable main span being connected to said arm forwardly of said shaft means and when a draw force is exerted on said arm it will exert said draw force on said second arm end portion rearwardly of said shaft means.

9. An archery bow comprising a body portion, a bowstring on said bow movable rearwardly in drawing movements of the bow, said bowstring having a pre-draw condition, the pre-draw condition being before a draw force is applied to said bowstring, a nocking point on said bowstring, first and second oppositely extending arms on said body portion with at least one of said arms being flexible for providing a tension for said bowstring, said arms each having a base portion and an end portion respectively, said base portions connected to said body portion, bowstring guide means for guiding said bowstring, said bowstring guide means comprising a first rotatable guide member on said first arm end portion and a second rotatable guide member on said second arm end portion, said bowstring including a main span and a pair of end spans, said bowstring main span extending between said first and second rotatable guide members, said pair of bowstring end spans wrapping around said first and second rotatable guide members respectively, eccentric means on said bow connected to said first rotatable guide member for controlling a break-over tension in said bowstring, a compound cable including a compound cable main span and a compound cable end span, said compound cable end span wrapping around said eccentric means, said compound cable main span extending between said eccentric means and said second arm end portion, shaft means on said second arm end portion rotatably supporting said second rotatable guide member, and connecting means on said second arm end portion for connecting said compound cable main span to said second arm end portion, said connecting means being positioned on said second arm end portion rearwardly of said shaft means, said second arm end portion including a slot means for receiving said second rotatable guide member, said shaft means comprising a shaft extending transversely across said slot means, said slot means having a forward wall portion and a rearward wall portion, both said forward and rearward wall portions of said slot means being closed, said compound cable main span being connected to said second arm end portion rearwardly of said shaft means.

10. The archery bow of claim 9 wherein said connecting means is positioned on said rearward wall portion for exerting a portion of the draw force on said second arm end portion rearwardly of said shaft means.

11. An archery bow comprising a body portion, a bowstring on said bow movable rearwardly in drawing movements of the bow, said bowstring having a pre-draw condition, the pre-draw condition being before a draw force is applied to said bowstring, a nocking point on said bowstring, first and second oppositely extending arms on said body portion with at least one of said arms being flexible for providing a tension for said bowstring, said arms each having a base portion and an end portion respectively, said base portions connected to said body portion, bowstring guide means for guiding said bowstring, said bowstring guide means comprising a first rotatable guide member on said first arm end portion and a second rotatable guide member on said second arm end portion, said bowstring including a main span and a pair of end spans, said bowstring main span extending between said first and second rotatable guide members, said pair of bowstring end spans wrapping around said first and second rotatable guide members respectively, eccentric means on said bow connected to said first rotatable guide member for controlling a break-over tension in said bowstring, a compound cable including a compound cable main span and a compound cable end span, said compound cable end span wrapping around said eccentric means, a shaft on said first arm end portion rotatably supporting said first rotatable guide member, a pylon extending rearwardly from said body portion, said compound cable main span extending from said eccentric means to said pylon, means on said pylon positioning a portion of said compound cable main span rearwardly of said shaft.

12. The archery bow of claim 11 wherein said means on said pylon positions a portion of said compound cable main span rearwardly of said eccentric means.

13. An archery bow comprising a body portion, a bowstring on said bow movable rearwardly in drawing movements of the bow, said bowstring having a pre-draw condition, the pre-draw condition being before a draw force is applied to said bowstring, a nocking point on said bowstring, first and second oppositely extending arms on said body portion with at least one of said arms being flexible for providing a tension for said bowstring, said arms each having a base portion and an end portion respectively, said base portions connected to said body portion, bowstring guide means for guiding said bowstring, said bowstring guide means comprising a first rotatable guide member on said first arm end portion and a second rotatable guide member on said second arm end portion, said bowstring including a main span and a pair of end spans, said bowstring main span extending between said first and second rotatable guide members, said pair of bowstring end spans wrapping around said first and second rotatable guide members respectively, eccentric means on said bow connected to said first rotatable guide member for controlling a break-over tension in said bowstring, a compound cable including a compound cable main span and a compound cable end span, said compound cable end span wrapping around said eccentric means, said compound cable main span extending between said eccentric means and said second arm end portion, shaft means on said second arm end portion rotatably supporting said second rotatable guide member, connecting means on said second arm end portion for connecting said compound cable main span to said second arm end portion, said connecting means being positioned on said second arm end portion rearwardly of said shaft means, and said connecting means includes multiple connections for selectively connecting said compound cable main span to said second arm end portion, said multiple connections being positioned on said second arm end portion rearwardly of said shaft means.

* * * * *